United States Patent [19]

Ligon

[11] Patent Number: 4,708,624

[45] Date of Patent: Nov. 24, 1987

[54] WASHER CUTTING APPARATUS

[76] Inventor: James T. Ligon, 800 South Main, Almont, Mich. 48003

[21] Appl. No.: 862,470

[22] Filed: May 12, 1986

Related U.S. Application Data

[62] Division of Ser. No. 623,170, Jun. 22, 1984, Pat. No. 4,617,849.

[51] Int. Cl.[4] ..... B26D 7/14

[52] U.S. Cl. ..... 425/306; 83/175; 83/620; 425/307; 425/315; 425/316

[58] Field of Search ..... 264/138, 150, 151, 157, 264/159, 163, 291, 306, 307, 316; 83/18, 54, 175, 620; 156/511; 10/72 R, 86 B; 425/306, 315, 316, 307, 311; 29/414, 417; 138/178

[56] References Cited

U.S. PATENT DOCUMENTS

| | | | |
|---|---|---|---|
| 523,584 | 7/1894 | MiVelaz | 425/311 X |
| 1,105,989 | 8/1914 | Miles | 425/307 X |
| 2,646,595 | 7/1953 | Leistensnider | 264/159 X |
| 2,945,263 | 7/1960 | Leistensnider | 264/159 |
| 3,086,246 | 4/1963 | Stone | 425/306 X |
| 3,477,895 | 11/1969 | Saver | 156/511 |
| 3,572,396 | 3/1971 | Hoffman et al. | 138/178 |
| 3,954,934 | 5/1976 | Newby | 264/163 X |
| 4,419,065 | 12/1983 | Cox | 425/306 X |
| 4,450,614 | 5/1984 | Repello | 29/417 |
| 4,573,383 | 3/1986 | Matsumoto | 83/620 X |

FOREIGN PATENT DOCUMENTS

| | | | |
|---|---|---|---|
| 51-37962 | 3/1976 | Japan | 264/159 |
| 581852 | 10/1946 | United Kingdom | 425/306 |

*Primary Examiner*—Richard L. Chiesa

*Attorney, Agent, or Firm*—Miller, Morriss & Pappas

[57] ABSTRACT

An apparatus for cutting washers, gaskets, seals and the like from tubular elongate stock having elastomeric properties in which the stock is clamped between two sets of spaced-apart jaws. The jaws are adjustably movable in respect to each other to stretch the tubular elastomeric material. The tubular stock in stretched condition is positioned between a cutting element having plural spaced-apart cutting blades and a cutter block in registry with the blades so that as cutting proceeds, a plurality of precision annular end products are produced with uniform thickness and with the cut surfaces all substantially precisely and repetitively parallel and accurate.

3 Claims, 6 Drawing Figures

FIG. 1
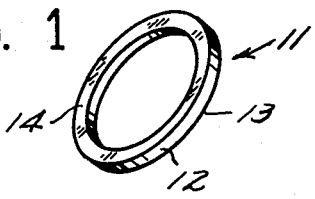
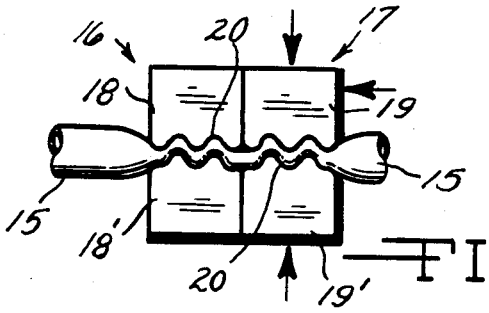
FIG. 3
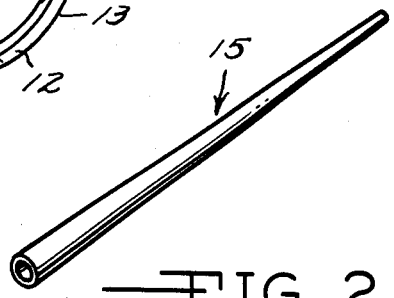
FIG. 2
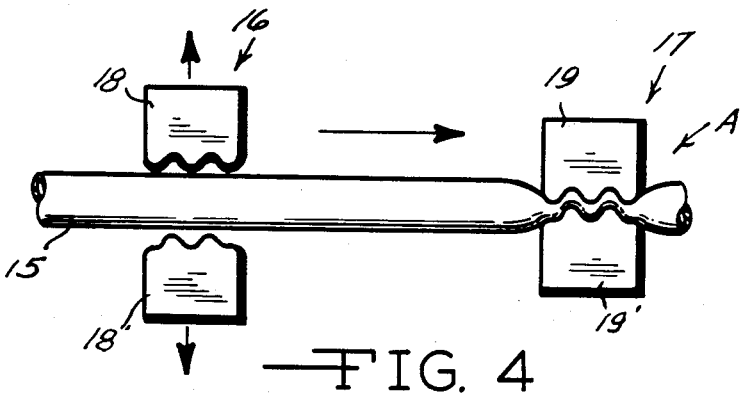
FIG. 4
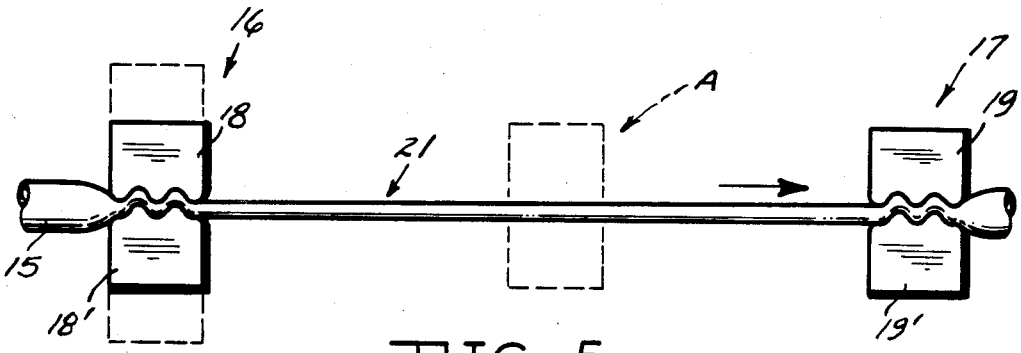
FIG. 5
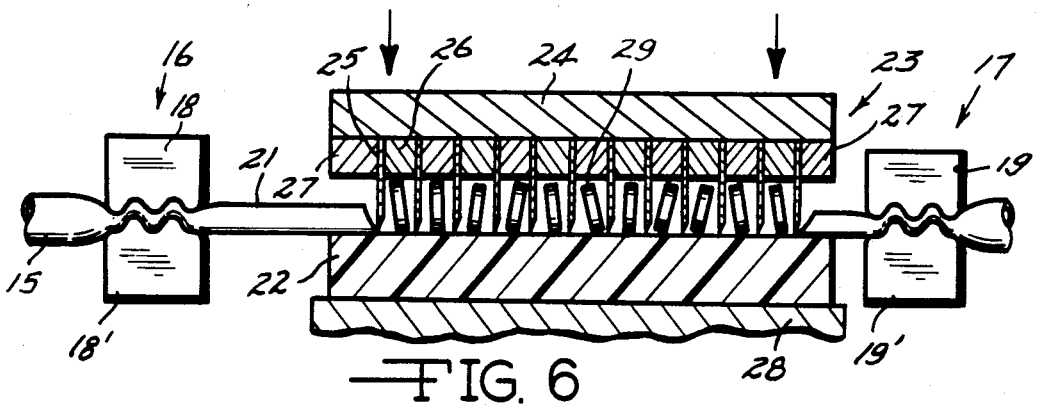
FIG. 6

WASHER CUTTING APPARATUS

This is a divisional of co-pending application Ser. No. 06/623,170 filed on June 22, 1984, now U.S. Pat. No. 4,617,849.

The present invention is directed to a new and improved method for cutting precision washers from resilient tubular stock such as rubber, polyethylene, vinyl, polyvinyl chloride, and other elastomeric materials. It is also directed to the apparatus for practicing the procedures in the preparation of precision washers and is a divisional application of the parent application, now U.S. Letters Patent No. 4,617,849.

Elastomeric washers are annular discs prepared generally by slicing tubular stock transversely of their axes. Some are, in fact, individually molded but the uses for such washers in high precision situations have radically expanded since the precision washers find use in anti-noise applications, insulating and isolating usage, gasket applications and fastener weather-proofing situations, to mention but a few.

The desired precision now sought in such washers goes to uniformity of washer thickness, squareness of cut across the axis of the tubular stock, parallelity of faces, and smoothness of the finished surfaces. Accordingly, the die cutting and existing spinning flywheel techniques for cutting produce a large quantity of unacceptable washer, seal or gasket products. In part, this is found to be caused by a drag at the interface between blade, die, or cutter which distorts the tubing during the cutting and consequently seriously causes variance in thickness, lack of squareness, parallelity of faces and even surface irregularities.

In general, existing methods and apparatus produce acceptable washers to a thickness of about 0.070 inches. Then the thickness of the washers start to vary and the washers assume a wedge-like profile.

The present process and apparatus seeks to solve the problem presented in the preparation of elastomeric washers to assure improved quality and precision, higher production, and minimal rejects. This approach makes possible substantial reduction in the mounting costs of fabrication of precision washers and improves the quality of apparatus in which such washers are used.

Other advantages, including machine simplicity and availability of increased numbers of product per batch, will be apparent as the description proceeds.

IN THE DRAWINGS

FIG. 1 is an enlarged perspective view of a washer prepared from elastomeric tubing and as desired in industry having uniform thickness, parallelity between the faces and squareness of cut across the axis of the tubular material.

FIG. 2 is a perspective view illustrating the tubular material from which the washer or gasket of FIG. 1 is cut.

FIG. 3 is a somewhat schematic side elevation view of the elastomeric tubing being gripped by a fixed position pair of jaws and an adjacent longitudinally movable pair of jaws, both closed on the tubing.

FIG. 4 is a side elevation as in FIG. 3 and illustrates the opening of the fixed position jaws and the movement of the movable pair of jaws carrying the tubing longitudinally through the open jaws.

FIG. 5 is a somewhat schematic side elevation view of the jaws, structure and tubing shown in FIGS. 3 and 4 in which the fixed jaws have closed on the tubing at the phantom line position of the moving jaws so that the tubing is stretched by the continuing movement of the longitudinally movable jaws and to the position, as indicated, with consequent reduction in tubing diameter.

FIG. 6 is a somewhat schematic side elevation view of the apparatus and procedure seen in the FIGS. 3–5, inclusive, and a cutting head with plural parallel knives at spaced intervals has been moved so as to sever the tubular elastomeric material uniformly and transversely of the longitudinal axis and the knives proceed to a cutting block of solid polyurethane.

GENERAL DESCRIPTION

In general, the procedural step making possible the improved end product is a procedure involving the stretching or elongation of an elongated elastomeric material or stock such as rubber (natural and synthetic) silicones, neoprenes, polyvinyl chlorides, polyesters, polyurethanes, polyisoprenes, nitrites, styrene butadienes, ethylene propylenes, fluorocarbons, polyolefins (including blends thereof), block polymers, ethylene copolymers, polysiloxane elastomers, and ionomers, and combinations of these having like stretch qualities along their elongate axes and then cutting the elastomeric material with plural spaced-apart razor-like blades or knives while elongated and where the guillotine-like motion of the cut is transverse of the longitudinal axis of the stock. "Transverse," where used herein, refers to a cut through the longitudinal axis of the tubular stock and whether or not at right angles to the elongate axis thereof. Preferably, the stock is tubular in the production of washers, gaskets, seals, and the like. For example, using 0.060 inch intervals in steel rule blades and with polyvinyl chloride tubing and surgical rubber tubing stretched to three times its free length with attendant reduction in tubing diameters, 0.020 inch washers were produced and the cutting, while under stretching stresses, produced excellent parallel cuts and with segments forming the washer products then shrinking when non-stressed and falling free from between the plural spaced-apart blades without distortion at the selected finished thickness. Repetitive accuracy was determined through the life cycle of the blades.

The procedure may also be used in the preparation of segments of elongate and stretchable elastomeric materials whereever the planes of segment faces must be parallel to each other.

Plural elastomeric tubes may be simultaneously gripped and cut using extended blades or knives. After cutting, the procedural aspects are repeated.

The apparatus is relatively simple comprising a pair of jaws which open and close upon the cross section of the tubular elastomeric material. A movable pair of jaws is also provided which closes and opens toward and away from the elastomeric tubing. The movable jaws grip the extension of the tubing from the fixed jaws and then the fixed jaws open so that the movable jaws can travel axially or longitudinally with the tubing. At a selected point in the movement of the movable jaws, the fixed jaws close on the elastomeric tubing. Further movement of the movable jaws stretches the tubing for the desired distance. A cutting head upon which are mounted plural spaced-apart knives closes on the stretched tube between the jaws in a guillotine-like movement. The stroke drives the knives or blades transversely through the axis of the tubular elastomeric material and the blades close against a cutting block or fixed platen of polyurethane or the like for a clean, crisp cut which isolates a washer or gasket product between adjacent blades. These washers shrink from elongation to the selected end size and fall free of the blades.

SPECIFIC DESCRIPTION

Referring to the drawing and with first specificity to the FIG. 1 thereof, the washer 11 produced by the process and apparatus of the present invention is shown. The thickness 12 is uniform. The faces 13 and 14 are parallel and are in planes transverse to the axis through the washer 11. The washer 11 is in the shape of an annulus and it will be appreciated that its inside and outside diameters are established by the elastomeric tubular structure 15 best seen in FIG. 2. The tube 15 is indicated in a non-stressed condition and the ID (inside diameter) and OD (outside diameter) are the selected ID and OD of the washer 11. As will be seen, the washer 11 is a segment cut from the elastomeric tubular material 16. The tube 15 is stretchable and the elastomeric material is exemplified by reference to the rubbers (natural and synthetic), neoprenes, polyvinyl chlorides, silicones, polyesters, polyurethanes, polyisoprenes, polyolefins (including blends thereof), nitrites, styrene butadienes, ethylene polypropylenes, fluorocarbons, block polymers, ethylene copolymers, polysiloxane elastomers and ionomers, and combinations of these having like properties.

In FIG. 3 the tubular material 15 is shown gripped by two pairs of adjacent jaws 16 and 17. As will be seen, the jaws 16 comprise jaw elements 18 and 18' and these remain relatively fixed while the jaws 17 comprising jaw elements 19 and 19' will be seen as movable away from the jaws 18. Mating jaw serrations 20 in both jaw pairs 16 and 17 are to firmly grip the tubing 15, as shown. Both pairs of jaws 16 and 17 selectively open and close on the tubing 15.

Referenced to the FIG. 4, the fixed pair of jaws 16 is open and the movable pair of jaws 17 clutches the end of the tube 15 and is moved by manual, mechanical, pneumatic, hydraulic, or electrical drive means, not shown, in a path extending on the axis of the tube 15, thereby extending the tube 15 between jaws 16 and 17. The extension continues as indicated by the force arrow to a selected position A, as indicated, and at that point of extension the tube 15 is not stressed or stretched.

By reference to FIG. 5, however, the jaws 16 close on the free end of the tubing 15 and fix it against the moving jaws 17. As the jaws 17 continue to move (see force arrow) away from point A and the jaws 16, the tube 15 is stretched axially and the diameters of the tubing 21 between the jaws 16 and 17 are reduced in accord with the amount of stretch and the nature of the elastomeric material in the tube 15. A full stress condition is shown for the particular tube 15. Both jaws 16 and 17 firmly grip the tubing 15.

By reference to FIG. 6, the movement of the movable jaws 17, while achieving the stretch and elongation of the tube 15 and reduction of diameters of the tubular portion 21 intermediate the jaws 16 and 17, has positioned the portion 21 of tube 15 between a cutting block 22 of material such as polyurethane and a moving cutter platen 23 which is registrably above the block 22. The cutting platen 23 comprises a plate 24 which is attached to a plurality of spaced-apart blades 25 at spacing intervals established by the spacer blocks 26 clamped in assembled relation with the blades or knives 25 by the perimeter retained pieces 27. As indicated by the force arrow, the movement of the platen 23 causes the blades to close on the block 22 and to shear the portion 21 of the tube in a cutting guillotine-like motion across the axis of the tube 15 and portion 21. The base 28 supports the block 22 against the thrust of the cutting plate 23. The blades 25 are like razor blades and upon contact with the portion 21 of the tube 15 segmentalizes the portion 21, as seen in the segments 29 which, upon severance, are relieved of the stretching stresses so that they shrink in thickness and occupy less space than suggested by the spacers 26 and expand their diameters to that of the unstressed tube 15. Hence, the segments 29, now washers 11 in finished annular shape and size, are free of contact with the adjacent blade surfaces. When the platen 23 moves away from contact with the block 22, the washers 11 fall free of the platen 23.

As will be appreciated, the blades 25 are easily extendable to shear plural tubes 15 in parallel adjacent orientation between the jaws 16 and 17 to extend production.

The resultant product, as washers 11, are uniform in thickness 12, have parallel faces 13 and 14, and are squared from the longitudinal axis of the tube 15 where the transverse cut is at right angles to the longitudinal axis of tube 15. The product is highly precise and production, as described, eliminates the considerable loss in rejects experienced with prior forms of manufacture. The accuracy at diameters below ½ inch and a thickness of 0.020 inches in surgical rubber tubing (for example) has proved highly unusual over prior art wedge forming tendencies. The primary procedural step is in stretching or pulling the elastomeric tubing and cutting the tubing cleanly with a single transverse pass of plural blades spaced at selected intervals based on the desired ultimate size of the washers or annular seals 11. Thus, the parallel blades move simultaneously through the longitudinal axis of the stock.

The apparatus is necessarily simple and straightforward as is the procedure and the results are very unobvious in light of current known practice. The contribution here has substantially advanced the art of precision preparation of elastomeric washers.

Having thus described my invention and a preferred embodiment thereof, others will perceive improvements, changes and modifications and such improvements, changes and modifications falling within the scope of the following claims are intended to be included herein, limited only by the scope of the following claims.

I claim:

1. An apparatus for the manufacture of high precision substantially parallel faced washers from stretchable elastomeric tubing comprising:

a first jaw structure selectively holding and releasing a tubular length of elastomeric material;

a second jaw structure movable toward and away from said first jaw structure and said second jaw structure selectively holding and releasing said length of tubular elastomeric material;

a cutting platen including plural parallel spaced-apart blades and located between said first and second jaw structures when said jaw structures are extended and said cutting platen movable transversely and through an axis extending between said first and second jaw structures; and a cutting block platen in the path of movement of said cutting platen and engaging said cutting platen blades upon completion of each stroke of said cutting platen.

2. An apparatus in accord with claim 1 wherein the interval between said blades in said cutting platen is selectively adjustable and wherein the extension of said jaw structures is selectively adjustable.

3. An apparatus for cutting precision washers from stretchable elastomeric tubing comprising:

a first fixed jaw structure having cooperating gripping surfaces and selectively and firmly holding and releasing a tubular length of elastomeric material;

a second movable jaw structure having cooperating gripping surfaces and selectively and firmly holding and releasing said tubular length of elastomeric material and movable toward and away from said first jaw structure to stretch said tubular length of elastomeric tubing between said jaw structures;

a cutting platen having plural parallel spaced-apart internal adjustable blades positioned adjacent the said length of tubular elastomeric material and upon extension of said jaws relatively movable transverse to the axis of said tubular length of elastomeric material and through the said tubular length of elastomeric material and through the axis between said jaws; and a cutting block platen opposite to said cutting platen and in functional register with said cutting platen and engaging said cutting platen blades upon completion of each cutting stroke of said cutting platen and forming plural high precision parallel-faced uniform thickness washers from said tubular elastomeric material on each stroke of said cutting platen.

* * * * *